United States Patent [19]

Fischer et al.

[11] 4,371,323

[45] Feb. 1, 1983

[54] SPIRAL ROTATION DISPLACEMENT MACHINE WITH PARALLEL MOTION DEVICES ENSURING RELATIVE TORSIONAL RIGIDITY

[75] Inventors: Berthold Fischer, Erftstadt-Lechenich; Hans-Peter Kabelitz, Cologne; Andreas Schmitz, Weilerswist, all of Fed. Rep. of Germany

[73] Assignee: Leybold Heraeus GmbH, Cologne, Fed. Rep. of Germany

[21] Appl. No.: 164,106

[22] Filed: Jun. 30, 1980

[30] Foreign Application Priority Data

Jul. 9, 1979 [DE] Fed. Rep. of Germany ..... 2927690

[51] Int. Cl.[3] ..... F01C 1/02; F01C 21/00; F16D 3/04

[52] U.S. Cl. ..... 418/55; 418/57; 418/182; 464/84

[58] Field of Search ..... 418/55, 57, 182; 64/31; 464/84, 100, 102

[56] References Cited

U.S. PATENT DOCUMENTS

| | | | |
|---|---|---|---|
| 2,475,010 | 7/1949 | Chilton | 64/31 |
| 2,721,457 | 10/1955 | Moore | 64/31 |
| 3,924,977 | 12/1975 | McCullough | 418/57 |
| 4,040,270 | 8/1977 | Chivari | 64/31 |

FOREIGN PATENT DOCUMENTS

| | | | |
|---|---|---|---|
| 745135 | 2/1933 | France | 64/31 |

*Primary Examiner*—John J. Vrablik

[57] ABSTRACT

A displacement machine operating according to the spiral principle has at least one parallel motion guide device provided to ensure a torsionally rigid relative movement of two displacement elements.

12 Claims, 3 Drawing Figures

SPIRAL ROTATION DISPLACEMENT MACHINE WITH PARALLEL MOTION DEVICES ENSURING RELATIVE TORSIONAL RIGIDITY

BACKGROUND OF THE INVENTION

The present invention relates to a displacement machine such as a compressor, vacuum pump or the like operating according to the spiral principle and comprising two displacement elements that can be displaced relative to one another so as to execute a translational rotary movement.

Compressors, vacuum pumps and other displacement machines operating according to the spiral principle have been known for a fairly long time as can be seen for example in German Auslegeschrift No. 22 25 327 and German Offenlegungsschrift No. 26 03 462. The displacement is effected by two displacement elements or units, each of which essentially consists of a base plate with a spiral wall formed thereon defining a spiral recess. The spiral wall of each displacement element axially interpenetrates the spiral recess of the other element. By virtue of a generally circular but purely translational relative movement (parallel movement) of the two displacement units, the contact points move in the same direction or sense between the spiral walls and recesses, with the result that, depending on the rotational direction of the relative movement, the points move radially either from the outside to the inside or from the inside to the outside.

As is known, such displacement machines can be driven in two ways. The first way is to fix one displacement element and then cause the second element to execute the desired, generally rotary relative movement, via an eccentric drive means, generally a crank mechanism. In the second way, assuming a circular relative movement is desired, is to mount both displacement elements so that they can rotate the rotational axes being displaced by the desired degree of eccentricity. As soon as the spiral walls and recesses cover a circumferential angle of at least 2 $\pi$, permanent radial contact between the spiral walls exists in at least one point. As soon as the area of mutual contact between the spiral walls and recesses is at least more than double (circumferential angle 4 $\pi$), at least two radial contact points permanently exist. In the latter case, sickle-shaped hollow spaces are formed between two contact points, in which a fluid can be conveyed in a unidirectional manner by means of the aforementioned relative movement.

The unidirectional conveying processes with low relative velocities of the displacement elements, wherein specific regions of the spiral walls and recesses are always associated only with the inlet region or outlet region, makes the use of pumps and compressors according to the spiral principle appear attractive in cases where high compression ratios should be produced without lubrication or with only a small degree of lubrication. Oilless displacement machines are preferred for reasons of servicing and operating costs, and environmental protection. There are also cases where oil is not only undesirable but is impermissible, e.g. on account of the danger of explosion.

It has in any case been found that the theoretically achievable high compression ratios and the simple manner of operation are difficult to realize in practice since a reliable and precise relative rotary motion and sealing at the radial contact points between the spiral walls and recesses is not easy to achieve. If a clean and smooth relative rotary motion at the contact points is not ensured, the result is increased wear and tear and localized heating at the spiral contours, and consequently the bearings weld together and seize up.

The main causes of an insufficiently clean and smooth relative rotary motion at the contact points may be attributed to:

(a) insufficient parallel guidance of the two displacement elements, (b) insufficient machining accuracy of the spiral contours, and (c) thermally produced contour variations or play on the spiral contours and at the contact points.

Known solutions to the aforementioned problems include, inter alia, highly accurate, adjustable crank drives as a parallel guidance system, precision machined spiral contours in air-conditioned areas, thermostatic regulation of the displacement units by means of a smooth circulation of cooling oil, and the like as can be seen for example in German Auslegeschrift No. 22 25 327. However, the aforementioned solutions involve a much higher expenditure in production costs than in the case of oillubricated pumps and compressors, such as rotary vane vacuum pumps and the like. For this reason spiral displacement machines have hitherto only been employed where, on account of the lack of alternative solutions, the high costs involved have to be borne.

SUMMARY OF THE INVENTION

The object of the present invention is to provide a displacement machine, such as a compressor, vacuum pump or the like, operating according to the spiral principle with two displacement elements that can be displaced relative to one another so as to execute a translational rotary movement, and in which the desired movement of the displacement elements relative to one another can be guaranteed in a simple manner.

In accordance with the invention this objective is achieved by the provision of means to ensure relative torsional rigidity of the elements while executing such translational movement, the means comprising two guides arranged substantially perpendicular to one another, of which at least one is a parallel motion device.

It is particularly advantageous in this connection if the at least one parallel motion device is formed by a pair of leaf springs.

In a displacement machine operating according to the spiral principle and having the above features the displacement elements are guided completely free from play with respect to one another. If both displacement elements contact one another, there is the further advantage that the guide means according to the invention is able to compensate for any shape and dimensional differences produced by manufacturing tolerances, assembly or installation inaccuracies, or thermal expansions. Overall, a displacement machine designed according to the invention can thus be manufactured at considerably lower cost since the requirements placed on manufacturing tolerances can be considerably reduced.

The invention will now be further described with reference to the accompanying drawings in which:

DETAILED DESCRIPTION OF THE INVENTION

Figure 1:
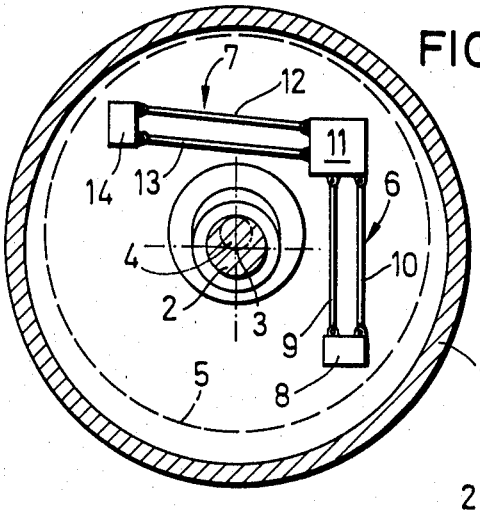
FIG. 1 is a diagrammatic section through a displacement machine to which the invention is applied.
Figure 2:
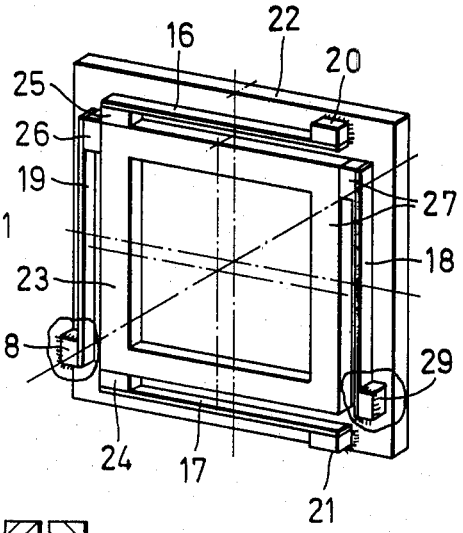
FIG. 2 is a perspective illustration showing the principles inherent in a preferred embodiment of the guide means.
Figure 3:
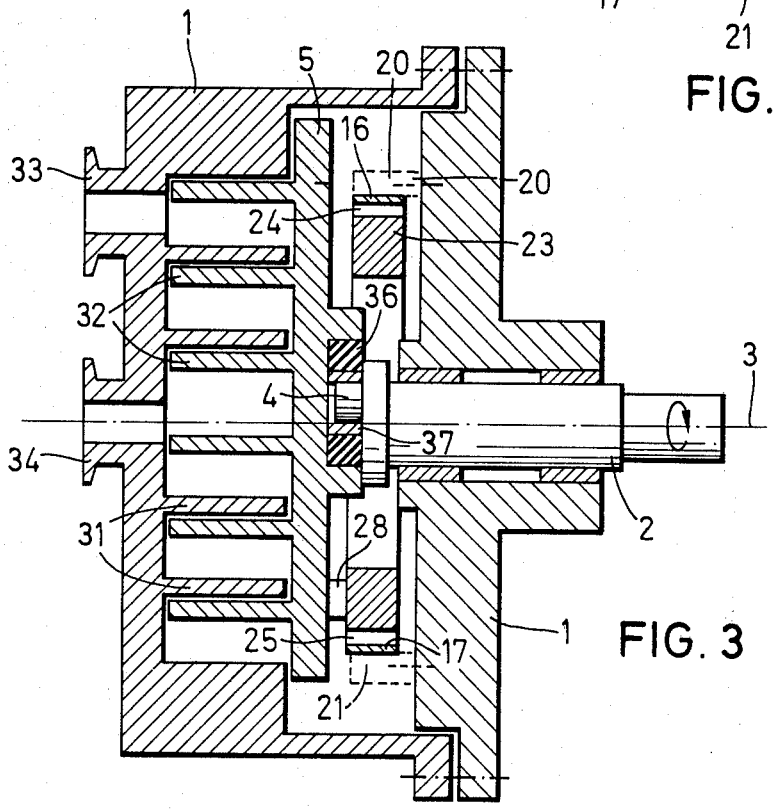
FIG. 3 is an axial cross-section through a preferred embodiment of a displacement machine according to the present invention.

Referring to FIGS. 1–3, a displacement machine has a circular housing 1. A drive shaft 2 is mounted centrally in housing 1 for rotation about axis 3 (see also FIG. 3). The end of the shaft 2 situated in the housing 1 carries a crank drive 4 which causes a displacement element 5, shown only as a dotted circle in FIG. 1, to execute a circular rotation. In order to ensure a completely torsionally rigid translational relative movement, in the embodiment according to FIG. 1 there is provided guide means in the form of two parallel motion linkages 6 and 7 arranged substantially perpendicular to one another. A base 8 is secured in the housing 1, in which two parallelogram arms 9 and 10 are hinged at one of their ends so as to pivot about axes parallel to the axis 3. They are pivotally hinged at their other ends to a coupling element 11, likewise so that they can pivot about axes parallel to the axis 3. The parallel linkage 7 similarly has two parallelogram arms 12 and 13 that are hinged at one end to the coupling element 11 and at their other end to a base 14, again in such a manner that they can pivot about axes parallel to the axis 3. The base 14 is rigidly connected to the displacement element 5. As a result of this parallelogram guidance system the displacement element 5 is guided in a torsionally rigid manner with respect to the housing 1, and in fact in a plane that lies vertically with respect to the rotational axis 4 (and to the parallelogram arm axes).

The embodiment according to FIG. 2 illustrates a form of the parallel motion guide means comprising two pairs of leaf spring 16, 17 and 18, 19. The pair of leaf springs 16, 17 is fixed at bases 20 and 21 to a disc or plate 22 which carries a first displacement element, not illustrated for the sake of clarity. The leaf springs 16 and 17 are secured at their free ends to a square frame 23, by bases 24 and 25. The leaf springs 18 and 19 are arranged substantially perpendicular to the leaf springs 16 and 17, and are rigidly connected by bases 26 and 27 to the frame 23, and via the bases 28 and 29 to the second displacement element, likewise not illustrated for the sake of clarity. The leaf springs 16 to 19 are in each case arranged laterally outside the frame 23, thereby providing a concise design and system of construction. Their longitudinal axes and their spring deflections lie parallel to the plane of the desired translational circular movement.

FIG. 3 shows a displacement machine with parallel motion devices of the type illustrated in FIG. 2. The first, stationary and fixed displacement element is formed by the housing 1 itself, and has the spiral wall projections 31. The displacement element 5 with the projections 32 executes a translational circular movement relative thereto, driven by the crank 4. This movement produces the desired conveyance of the medium from one of the two ports 33 and 34 to the other (depending on the direction of rotation). The crank 4 is elastically mounted in the rotating displacement element 5, with the result that by this measure alone shape and dimensional differences produced by too high manufacturing tolerances can be compensated. In addition, the parallel motion guide means according to FIG. 2 is provided at the level of the crank 4. FIG. 2 shows the bases 20 and 21 by which the leaf springs 16 and 17 are connected to the housing 1 and thus to the stationary displacement element. The bases 24 and 25 connect the leaf springs 16 and 17 to the frame 23. Finally, the base 28 which connects the leaf spring 19 to the circulating displacement element 5 can also be seen.

The crank 4 is elastically mounted in the rotating displacement element 5 with the aid of an elastic ring 36 which surrounds a bearing sleeve 37. Instead of this elastic mounting on the drive output side, the crank can be elastically mounted in the housing 1 on the drive input side.

With each circular movement of the circulating displacement element 5 the leaf springs undergo a load cycle. The length of the leaf springs and/or their material must be chosen so that the bending stresses resulting from the load cycles are far below the fatigue strength of the springs. In addition, the springs may be suitably prestressed in such a way that the pretensioning force produced thereby is permanently directed through the contact point or points between the two projections 31 and 32. In this way it is ensured that the projections always maintain their contact. If this were not the case, there could be the danger that in certain circumstances the sealing conditions would be considerably worsened.

The means according to the invention for guiding the two displacement elements may be employed in displacement machines having a stationary and a circulating displacement element, and also in displacement machines having two rotatably mounted displacement elements. In the first case the frame 23 for example execute only a translational movement. In the second case, the frame likewise executes a rotary movement.

What is claimed is:

1. A rotary spiral-type fluid displacement machine comprising: two displacement elements mounted for displacement relative to one another so as to execute a translation rotary movement; and means ensuring the relative torsional rigidity of the elements while executing such translation movement, said means comprising two guides disposed substantially perpendicular to one another; wherein at least one guide comprises a parallel motion device comprising a pair of leaf springs.

2. A displacement machine according to claim 1, further comprising two displacement elements and two parallel motion devices and wherein said two displacement elements execute a translational rotary movement relative to one another, a first parallel motion device and means securing one end thereof to one of the displacement elements such that the path of its free end is parallel to the plane of the circular movement, means securing said free end at least indirectly to one end of the second parallel motion device such that the path of the free end of the second device is similarly parallel to the plane of the circular movement, and the free end of the second device is connected to the other displacement element.

3. A displacement machine according to claim 1, further comprising an elastic suspension for at least one of the two displacement elements.

4. A displacement machine according to claim 1, wherein said leaf springs are configured such that the bending stresses resulting from the load cycles are far below the fatigue strength of the springs.

5. A displacement machine according to claim 1, wherein one or more of said leaf springs are prestressed such that the force exerted thereby on the displacement elements ensures constant contact of the projections of the displacement elements.

6. A displacement machine according to claim 1, further comprising a housing and two parallel motion devices and wherein one displacement element is fixed in the housing and the other displacement element is displacable relative thereto to execute a rotary movement, a first parallel motion device and means securing one end thereof at least indirectly to said housing such that the path of the free end thereof is parallel to the plane of the circular movement, means securing said free end at least indirectly to one end of the second parallel motion device such that the path of the free end of said second device is similarly parallel to the plane of the circular movement, and the free end of said second parallel motion device is connected to the second displacement element.

7. A displacement machine according to claim 6, further comprising a crank drive for the rotatable element and means elastically mounting the crank drive on at least one of the drive input and drive output side.

8. A displacement machine according to claim 1, wherein the parallel motion devices comprise two pairs of leaf springs.

9. A displacement machine according to claim 8, comprising two parallel motion devices and a coupling element connecting the first parallel motion device to the second parallel motion device.

10. A displacement machine according to claim 9, wherein the coupling element comprises a rectilinear frame.

11. A displacement machine according to claim 10, wherein the pairs of leaf springs forming the parallel motion devices are arranged laterally outside the frame.

12. A displacement machine according to claim 10 or claim 8, further comprising a crank drive for one of the displacement elements and wherein the frame is arranged at the level of the crank drive and surrounds the former.

* * * * *

UNITED STATES PATENT AND TRADEMARK OFFICE

CERTIFICATE OF CORRECTION

PATENT NO. : 4,371,323

DATED : February 1, 1983

INVENTOR(S) : Berthold Fischer et al

It is certified that error appears in the above-identified patent and that said Letters Patent is hereby corrected as shown below:

Claim 12, line 2, "8" should be -- 11 --.

Signed and Sealed this

*Twenty-sixth* Day of *March 1985*

[SEAL]

*Attest:*

DONALD J. QUIGG

*Attesting Officer*

*Acting Commissioner of Patents and Trademarks*